US006079386A

United States Patent [19]

Barker et al.

[11] Patent Number: 6,079,386

[45] Date of Patent: Jun. 27, 2000

[54] ROTARY MACHINE

[75] Inventors: Alan George Barker; Iain Robert Warner, both of Ipswich, United Kingdom

[73] Assignee: Tried Applied Technolog Limited, United Kingdom

[21] Appl. No.: 08/890,072

[22] Filed: Jul. 9, 1997

[30] Foreign Application Priority Data

Jul. 10, 1996 [GB] United Kingdom ..... 9614476

[51] Int. Cl.[7] ..... F02B 53/00

[52] U.S. Cl. ..... 123/249; 123/235; 418/188

[58] Field of Search ..... 123/235, 238, 123/249; 418/186, 187, 188

[56] References Cited

U.S. PATENT DOCUMENTS

| | | | |
|---|---|---|---|
| 397,707 | 2/1889 | Farrington | 418/186 |
| 516,385 | 3/1894 | Weston | 418/188 |
| 866,693 | 9/1907 | Southern et al. | 418/188 |
| 1,023,670 | 4/1912 | Miles | 123/249 |
| 1,231,640 | 7/1917 | O'Connor | 418/188 |

FOREIGN PATENT DOCUMENTS

| | | | |
|---|---|---|---|
| 0 066 255 | 5/1982 | European Pat. Off. . | |
| 609491 | 5/1926 | France | 418/187 |
| 199269 | 3/1939 | Switzerland | 418/188 |
| 248713 | 7/1969 | U.S.S.R. | 418/188 |
| 359 691 | 10/1931 | United Kingdom . | |
| 784 554 | 10/1957 | United Kingdom . | |
| 1 275 103 | 5/1972 | United Kingdom . | |

*Primary Examiner*—Michael Koczo
*Attorney, Agent, or Firm*—Charles D. Gunter, Jr.

[57] ABSTRACT

A rotary machine has two rotors (16,18) mounted for rotation on parallel axes, each in one of two intersecting cylindrical chambers (12,14). The rotor (16) has a hub (24) and a flap (26) extending radially from the hub into close proximity with, but not into contact with, the cylindrical wall of chamber (14). The rotor (18) has a hub and a radial recess (30) which accommodates the flap (26) as the rotors rotate. The rotors are linked to one another so that they rotate at the same angular speed but in opposite angular directions. The flap (26) divides the chamber (14) into two volumes, one either side of the flap. Working fluid is introduced through the first rotor and passes along a radial passage through the rotor to direct incoming working fluid from one side of the flap. into a volume on one side of the rotor. The working fluid can be provided from an external combustion chamber.

12 Claims, 8 Drawing Sheets

ROTARY MACHINE

This invention relates to a rotary machine which can be used either as an engine, in which energy is converted to rotary motion, or as a pump, in which rotary motion has a pumping action on a fluid.

One well known rotary engine is the so-called Wankel engine where a tri-lobal rotor rotates within a cylinder of oval cross section. This engine relies on effective sealing between the tips of the rotor and the walls of the chamber, and in practice this sealing is difficult to accomplish.

A wide variety of other rotary machines are known in the art where two parallel rotors rotate within two intersecting cylindrical chambers, so that the pitch circles of the rotors also intersect with one another, the circumference of the rotors being formed to allow the rotors to rotate. Examples of such machines are shown, for example, in GB 2 005 352 A and GB 2 073 324 A.

The present invention seeks to provide a machine which has advantages over the machines of the prior art, both in efficiency and in terms of service life.

According to the present invention, there is provided a rotary machine having two rotors mounted for rotation on parallel axes, each in one of two intersecting cylindrical chambers, a first of the rotors having a hub and a flap extending radially from the hub into close proximity with, but not into contact with, the cylindrical wall of the respective chamber, and the second of the rotors having a hub and a radial recess which accommodates the flap as the rotors rotate, the rotors being linked to one another so that they rotate at the same angular speed but in opposite angular directions, the flap dividing the chamber in which the first rotor rotates into two volumes, one either side of the flap, and the first rotor including an inlet for working fluid, the inlet communicating with a radial passage through the rotor to direct incoming working fluid into a volume on one side of the rotor.

The radial passage preferably extends from a hub of the first rotor into the flap, and ends in an outlet on one side of the flap. There may be a number of outlets, all on the same side of the flap, and all in communication with the same radial passage. Preferably the outlets are near to the radially outer edge of the flap. Where there are a number of outlets, those nearer the radially outer edge may be larger than those further from the edge.

The second rotor preferably has a diameter which, apart from the recess, is substantially equal to that of the chamber in which it rotates. The peripheral surface of the second rotor will lie close to, but not in contact with, the internal surface of the cylindrical chamber.

The two intersecting cylindrical chambers preferably both have the same diameter, and the rotors are linked to one another, externally of the chamber, by intermeshing gears which ensure that both rotors rotate at the same rate.

The first rotor may rotate on a spindle which may be hollow and may be divided to form an inlet passage at one end and an outlet passage at the other end, with the inlet and outlet passages being separated from one another by a division in the hollow spindle. Part of one end of the spindle can be cut away so that, in certain angular orientations, communication is opened between an external inlet passage and the center of the spindle, and in other angular orientations this communication is closed.

Alternatively, the first rotor may have a hollow hub which is in communication with the radial passage, and the hub may be supplied with pressurized working fluid through a port in an end face which periodically during each rotation cycle is in register with a corresponding port in another component which is exposed to the working fluid.

The machine is arranged so that, when functioning as an engine, compressed gas flows through the inlet, through the flap and out into a chamber defined between the first and second rotors. The pressure of the gas reacts against the external surface of the second rotor (and the position of this surface does not change radially) while forcing the flap to rotate about its axis. The result is rotary motion which can be harnessed to perform any desired function.

The machine can be provided with an external combustion chamber, in which a mixture of fuel and air can be exploded to produce a working fluid under pressure. The chamber can rotate with the first rotor.

The outlet passage is permanently open so that the gas in front of the flap can be exhausted to atmosphere, to maintain a steep pressure gradient across the flap. The outlet passage can be formed by a hole in the side of the chamber in which the first rotor rotates.

The position of the outlet passage can be set so that any residual pressure on the pressure side of the flap is also exhausted to atmosphere.

The invention will now be further described, by way of example, with reference to the accompanying drawings, in which.

Figure 1:
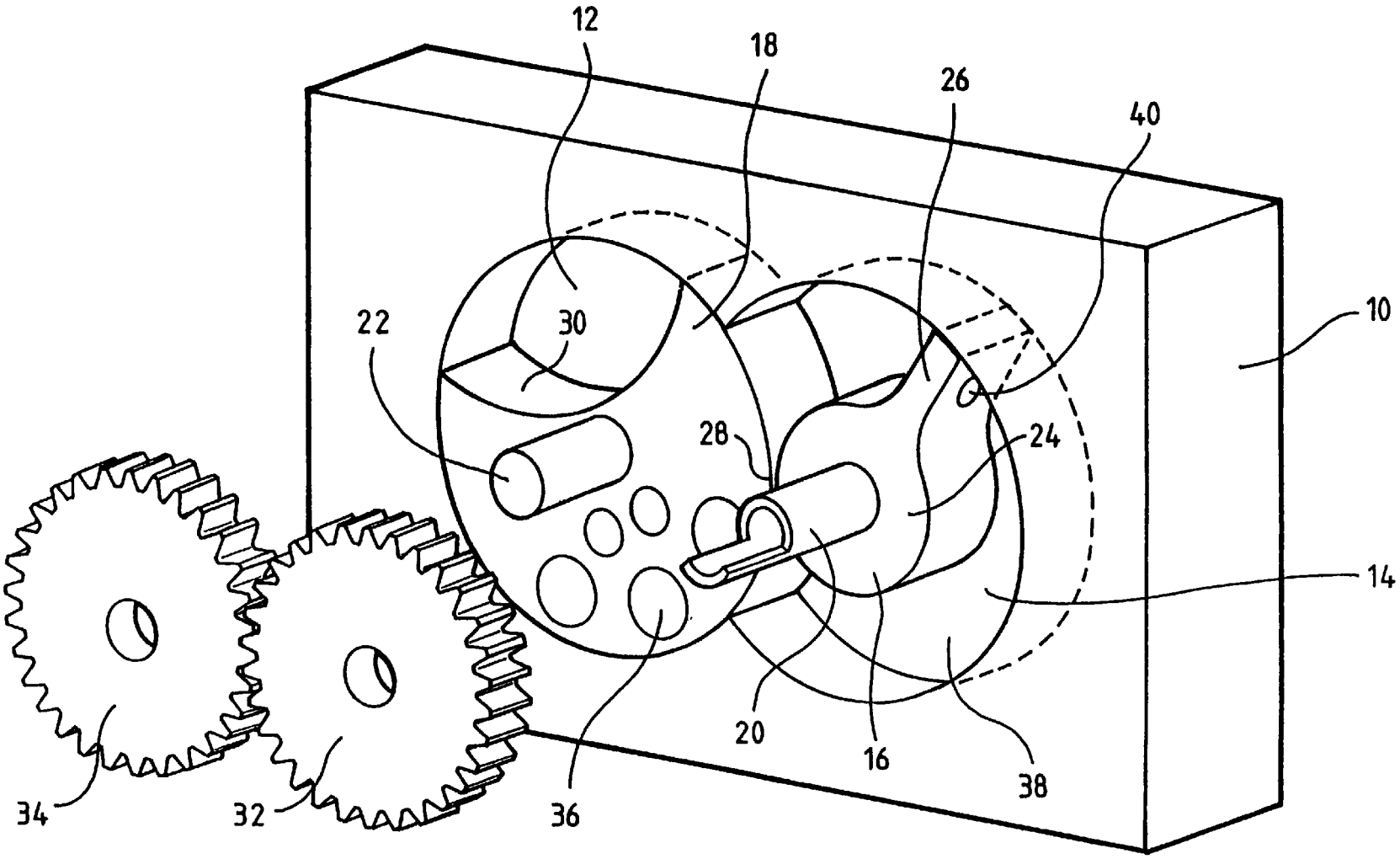
FIG. 1 is an exploded view of one embodiment of a rotary machine in accordance with the invention.

FIG. 1 shows a block 10 in which two intersecting cylindrical chambers 12 and 14 are formed. The chambers have closed bases, continuous cylindrical surfaces (apart from the region where the two chambers intersect with one another) and will be closed by a cover which is not shown in FIG. 1.

A first rotor 16 is mounted in the chamber 14 and a second rotor 18 is mounted in the chamber 12. The two rotors have respective spindles 20 and 22, and the base and cover of the chambers 12, 14 will allow passage of these spindles, and will allow for the housing of any bearings required to support the spindles, for rotation.

The rotor 16 has a central hub region 24 and a flap 26 extending radially outwardly and up to the internal surface of the cylindrical wall of the chamber 14. The radially outer end of the flap 26 will not however be in contact with the peripheral wall. It is not necessary for there to be an airtight seal between the tip of the flap and the wall; by using a wide tip to the flap 26, a substantial restriction will be formed to the flow of air past the tip, and this will provide as good a seal as is required to enable the machine to work as intended, without giving rise to any contact between the tip of the flap and the wall which could lead to adverse wear.

The second rotor 18 has a generally cylindrical circumferential form which is of substantially the same diameter as the chamber 12. However as described with relation to the tip of the flap, there will be no contact between the cylindrical surface of the second rotor 18 and the corresponding surface of the chamber 12. A part of the circumference of the second rotor 18 is cut away at 30.

When the two rotors are properly mounted within the block, on their spindles 20,22, the cylindrical surface of the hub region 24 of the rotor 16 will be almost, but not quite, in contact with the large diameter surface of the rotor 18. Again the narrow gap which exists here will effectively prevent air flowing backwards between the rotors.

The spindles 20 and 22 are fitted with meshing gear wheels 32, 34 with equal numbers of teeth, so that the two rotors are constrained to rotate at the same angular velocity. As the rotors rotate, the flap 24 will enter the recess 30 and will follow the curvature of the recess, again with a very narrow gap between the tip of the flap and the surface of the recess.

Some parts of the material of the second rotor 18 are removed, as shown by the holes bored in the material of the rotor at 36, to improve the rotational balance of this rotor.

In order to drive the engine, compressed gas is introduced into a working chamber 38, to produce the sequence of operations now to be described.

Figure 2:
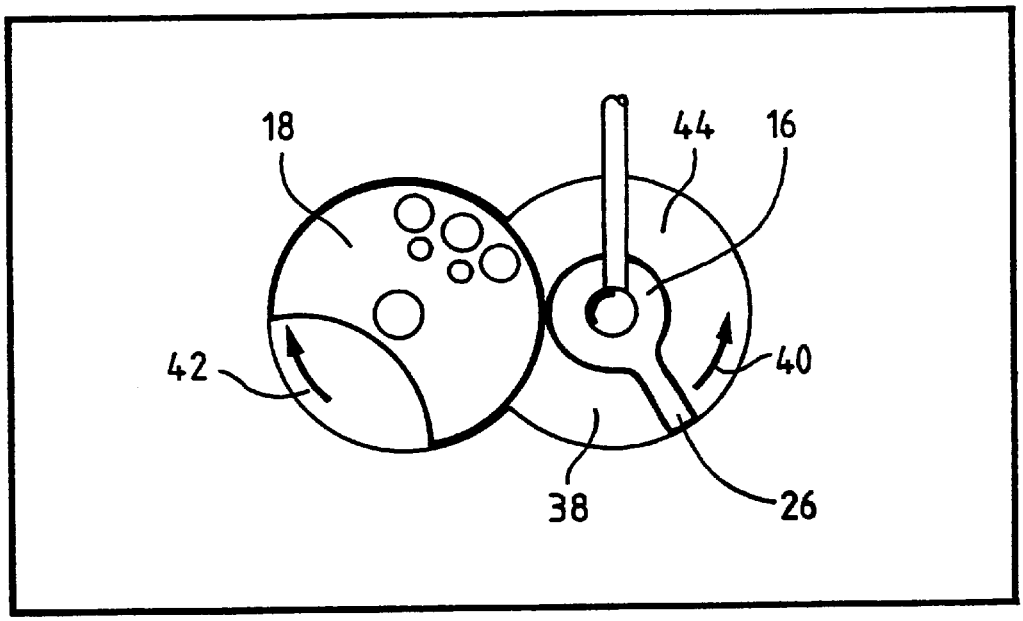
FIGS. 2, 3, 4 and 5 show sequential stages in one cycle of operation.

In operation, the cycle starts with the rotors 16 and 18 in the relative positions shown in FIG. 2. Compressed gas is forced into the working chamber 38 through an inlet aperture near to the tip of the flap. This increase of pressure in the working chamber 38 cannot affect the movement of the second rotor 18, because that part of the surface of this rotor which is exposed to the pressure is all at a constant distance from the axes of rotation of that rotor. However the pressure acts on the flap 26 to drive this around the axis in the direction indicated by an arrow 40. Through the action of the toothed gears 32,34 between the rotors 16,18 the rotor 18 will also rotate as indicated by an arrow 42.

Figure 3:
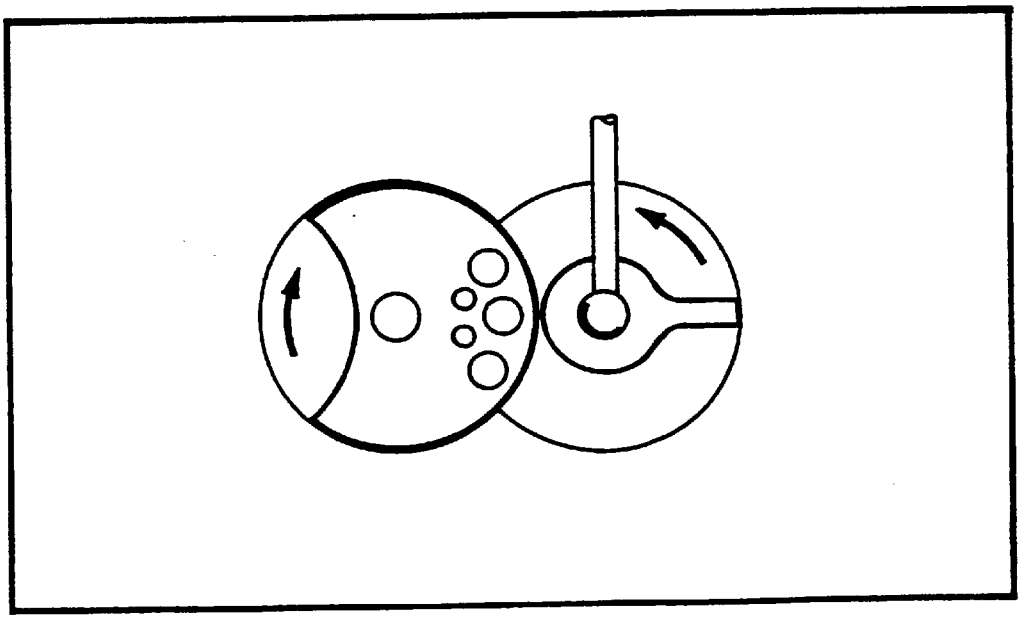

A second stage of operation is shown in FIG. 3, where the flap 26 is rotated a further 60° approximately in an anti-clockwise direction, with the hub region 24 of the first rotor still remaining substantially in contact with the cylindrical surface of the second rotor 18.

Figure 4:
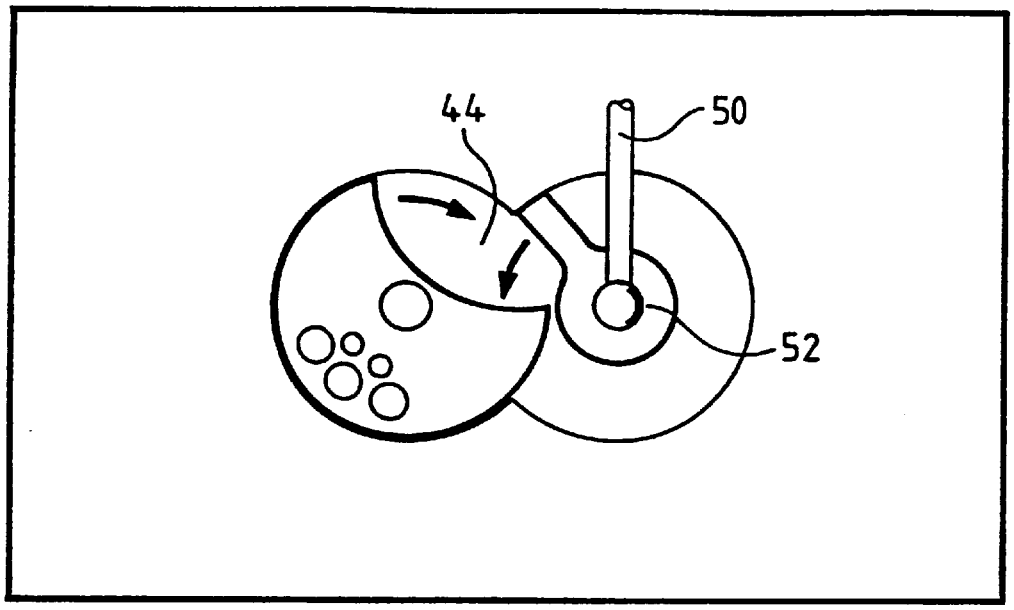

FIG. 4 shows the situation where the flap 26 has moved to the point where it is about to come out of contact with the surface of its cylinder 14. At this point the power stroke of the machine is at an end.

While this power stroke is taking place, i.e. throughout the stages of FIGS. 2, 3 and 4, the chamber ahead of the flap 26 (i.e. the chamber 44 in FIG. 2) is being vented. Pressure cannot therefore build up in this chamber to resist the rotation of the flap and the rotor 16.

Even in the position shown in FIG. 4, chamber 44 is vented. In this position the chamber 44 encompasses the space defined by the recess 30 of the second rotor 18.

Figure 5:
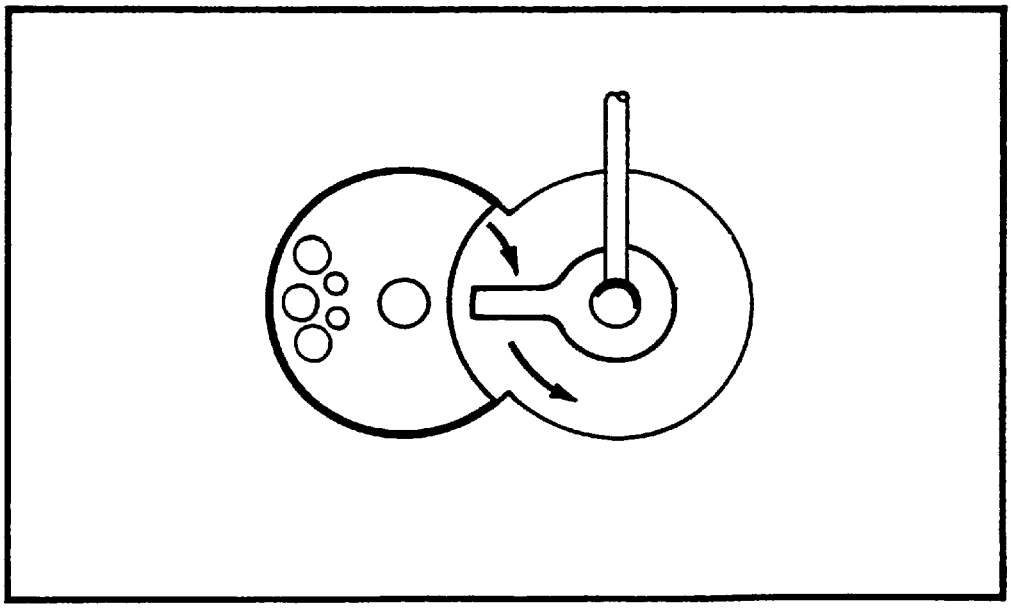

As the rotors travel from the FIG. 4 position, through the FIG. 5 position they are relying on the flywheel effect, i.e. on the inertia of the rotors, particularly the second rotor 18. In this position the compressed gas inlet is blocked off.

In FIGS. 2–4, the position of the compressed gas inlet passage is indicated at 50. The spindle 20 which is fixed for rotation with the rotor 16 has an axial extension which forms a partly cut-away shield for the inlet passage. Consideration of FIGS. 2–4 will show that the inlet 50 is just being uncovered in FIG. 2, remains uncovered throughout the positions of FIG. 3 and FIG. 4 (in FIG. 4 the inlet is just beginning to be recovered) and in FIG. 5 the inlet is fully closed off.

Opening and closing of the outlet is not critical, and the outlet passage will therefore be permanently open.

Figure 6:
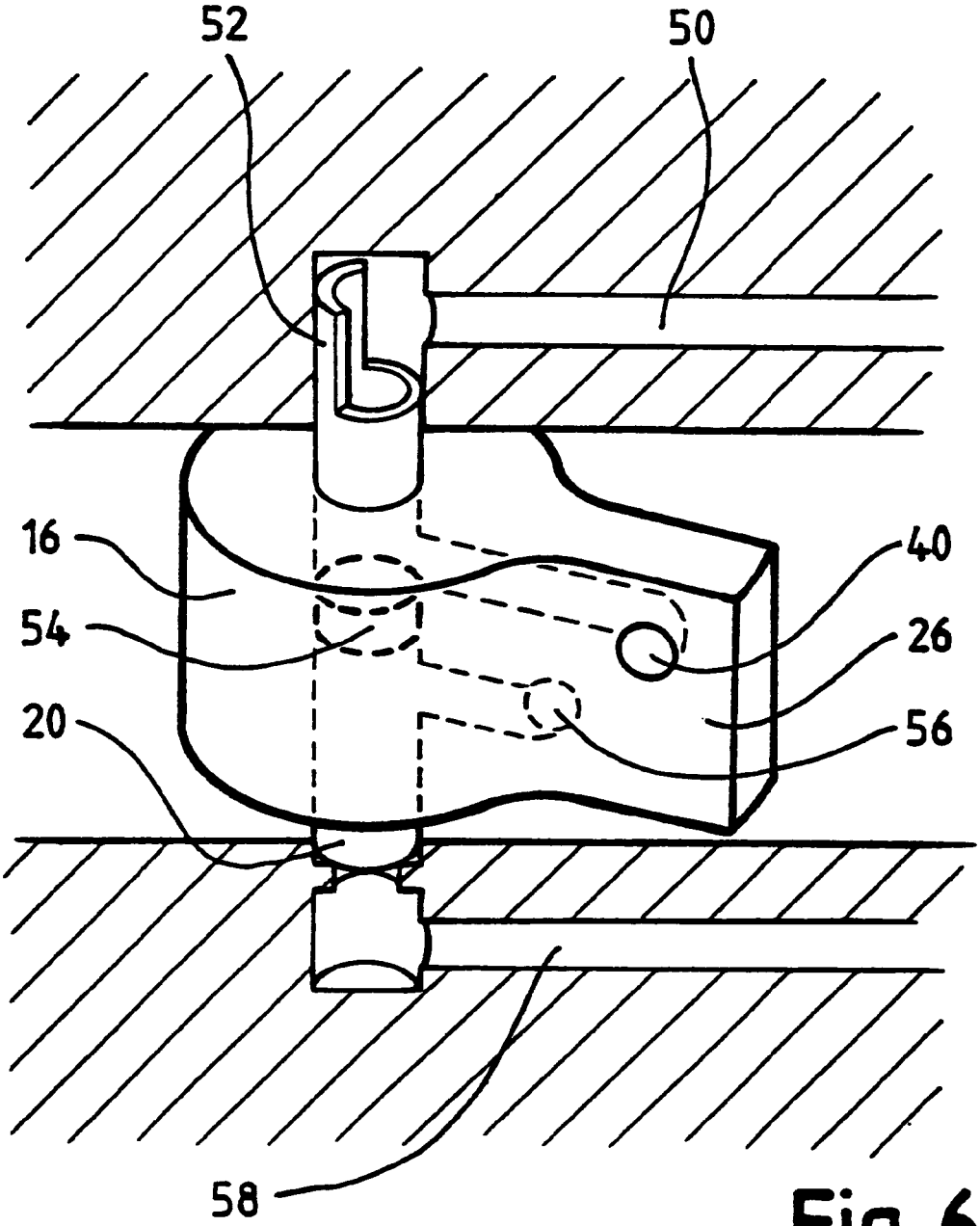
FIG. 6 illustrates valving arrangements associated with one of the rotors.

FIG. 6 illustrates how the fluid feed to and from the opposite sides of the flap 26 is arranged.

The rotor 16 is mounted on a spindle 20. The spindle is mounted for rotation in the body 10 in the upper and lower faces of the cylindrical chamber 14. These body portions are shown only in part and in cross section in FIG. 6, for illustrative purposes.

The spindle 20 is hollow and extends right through the rotor 16, but has a plug 54 at the centre. Thus the upper and lower bores of the spindle are independent from one another.

The upper bore in FIG. 6 communicates with an inlet passage leading through the flap and exiting at an outlet aperture 40. This aperture is in the face of the flap which is front most in FIG. 6. The lower bore of the spindle 20 communicates with an outlet aperture 56 which is open to the opposite side of the flap 26 from the aperture 40.

The upper end of the spindle 20 has a shield portion 52 which is open around part of its circumference and closed around another part of its circumference. In the position shown in FIG. 6, there is communication between the inlet passage 50, the upper bore of the spindle 20 and the internal outlet aperture 40. In the lower half of FIG. 6, communication is open at all times between the outlet aperture 56 and an outlet passage 58. The particular point in the cycle at which opening and closing will take place will be determined by the circumferential extent of the shielding portion 52.

FIGS. 7 to 10 show a machine where an external combustion chamber is provided to produce pressurized working fluid to drive the rotors. In these figures, parts which correspond to parts already described will be identified by the same reference numerals prefixed by '1'.

Figure 7:
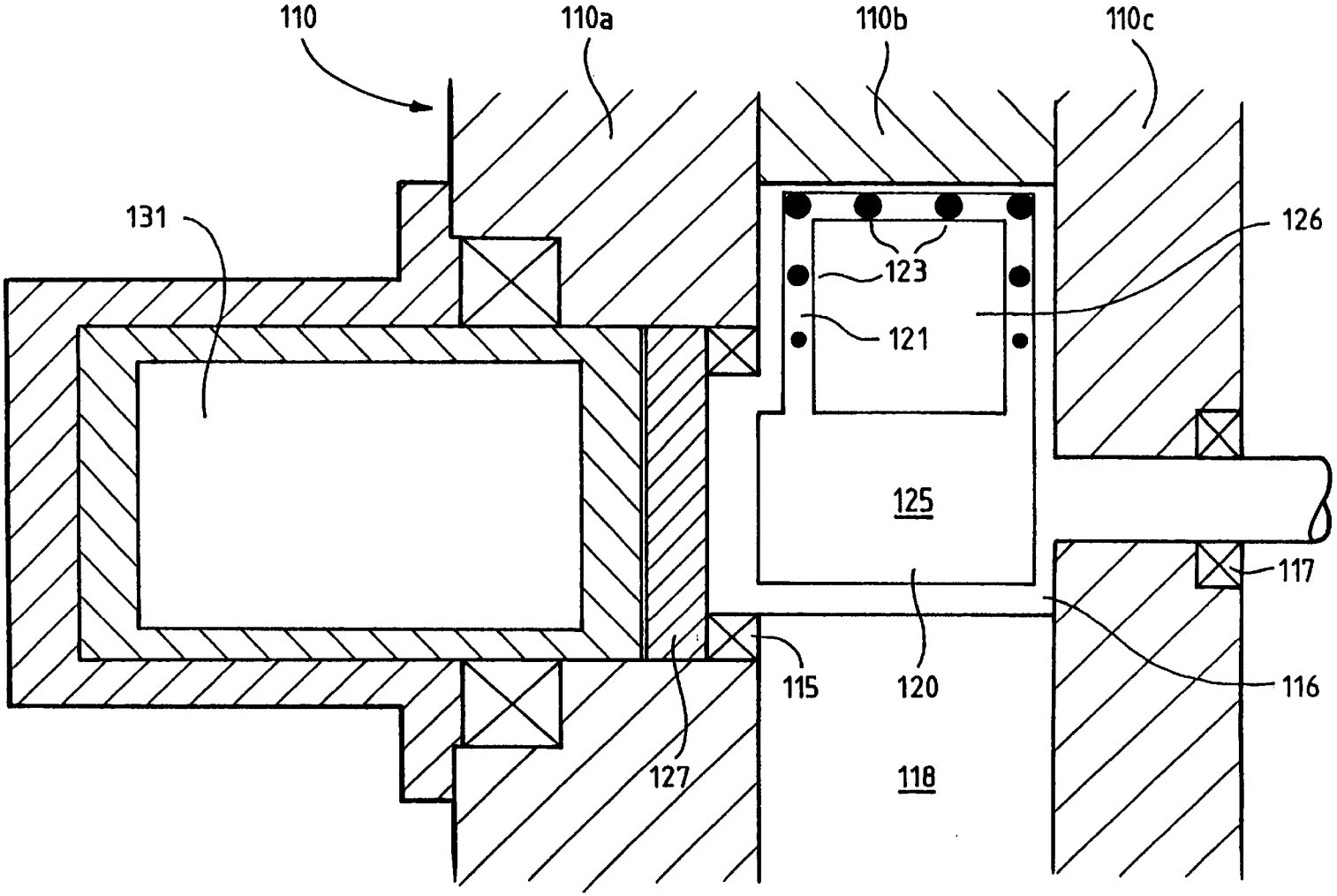
FIG. 7 is a cross-section through a second embodiment of rotary machine in accordance with the invention.

FIG. 7 shows the block 110 formed from three plates 110*a*, 110*b* and 110*c*. The middle plate b is formed with intersecting cylindrical chamber in which the rotors will rotate. The outer plates a and c form the end walls of the chambers. The first rotor 116 is shown supported in bearings 115 and 117 in the end wall plates a, c. Only a part of the second rotor 118 is visible in this figure.

Figure 8:
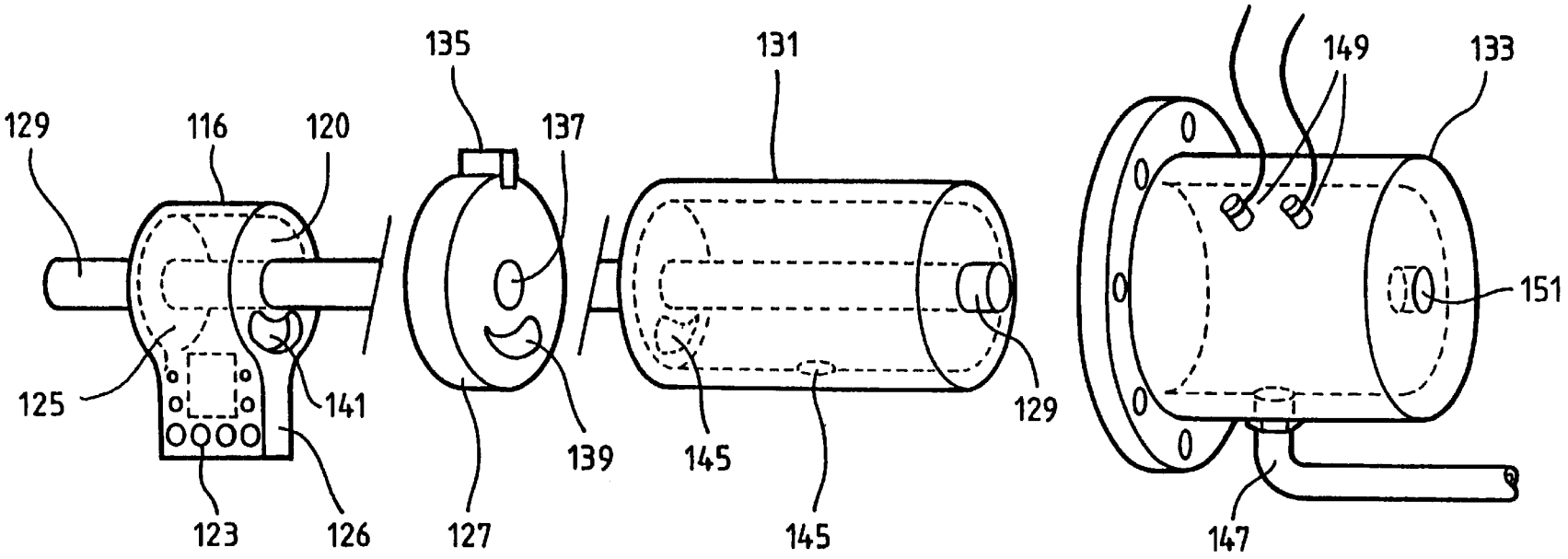
FIG. 8 is an exploded view of the machine of FIG. 7.
Figure 9:
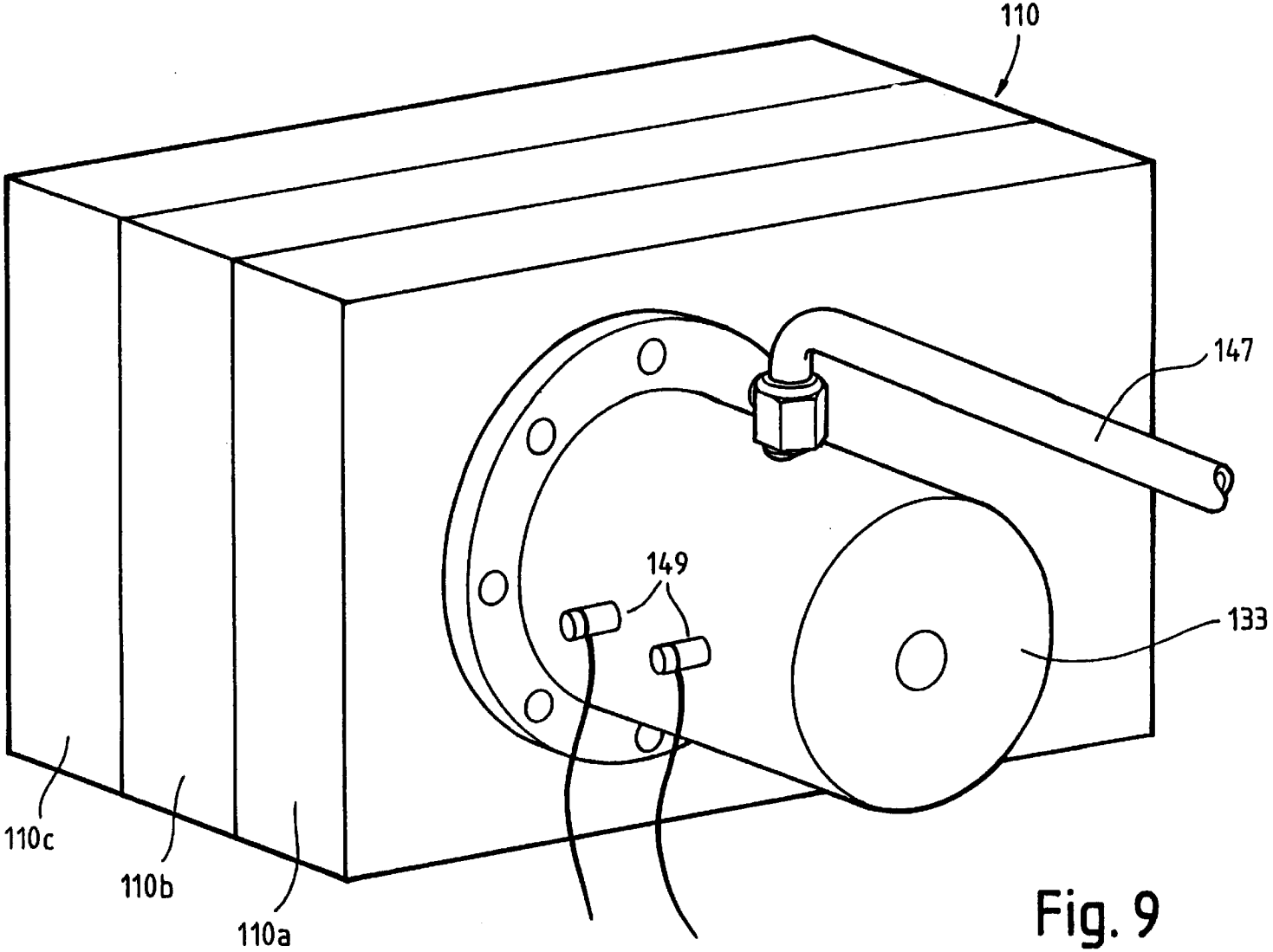
FIG. 9 is an external view of the machine of FIG. 7.

The rotor 116 has a hollow hub 120 forming a cavity 125 and a radial flap 126 (see also FIG. 8). An outlet passage 121 leads from the cavity 125 in the rotor hub to a set of outlet openings 123, which are on one face of the rotor only. It will be seen that there are a number of these outlet openings, spaced along the passage 121, and that the passage 121 is a loop, with both of its ends connected to the cavity 125 in the hub 120.

A fixed timing disc 127 is secured in the outer plate 110*a* and the spindle 129 of the rotor passes through this timing plate. A combustion chamber 131 is fixed to the spindle 129, on the side of the timing disc opposite to the rotor, and rotates with the rotor 116.

FIG. 8, which is an exploded view of these components, shows the rotor 116 with its hub 120 and flap 126, the timing disc 127 and the combustion chamber 131. The combustion chamber rotates within a housing 133.

The timing disc is held against rotation in the plate a by a key 135. The rotor and the combustion chamber are both fixed on the spindle 129 which passes through an opening 137 in the disc. The disc has a gas inlet passage 139, and there are corresponding ports 141 and 143 in the rotor and the combustion chamber. The ports 141 and 143 are lined up with each other, and once in each revolution, the ports 141 and 143 will overlap with the opening 137, so that compressed gas in the combustion chamber can pass into the hollow rotor hub 120.

The passage 139 and at least one of the ports 141, 143 are droplet-shaped, so that as relative rotation takes place, at first only a small area of communication is available for gas flow from the chamber 131 to the rotor hub 120. Then, as the relative rotation continues, the area of the opening between the chamber and the hub cavity increases to a maximum, before being closed again. The ports 141,143 are thus only in communication with each other once in each revolution.

The combustion chamber has a fuel mixture inlet opening 145 which registers, once in each revolution of the combustion chamber, with an inlet passage 147 in the housing 133. Suitable seals will be provided between the housing and the combustion chamber to prevent leakage of the fuel mixture. The combustion chamber also has an ignition spark device which ignites the mixture within the chamber. The spark device is not shown in the figures, but will be operated to generate a spark each time the chamber passes two electrical contacts 149 in the wall of the housing 133. The electrical contacts 149 will pass a high tension voltage to the spark device.

The housing 133 also has a bearing socket 151 for supporting the end of the spindle 129 which extends from the end of the combustion chamber 131.

In operation, a volume of fuel mixture is introduced into the chamber 131 at the time when the ports 145,147 coincide. This charging of the fuel mixture may be assisted by pressurized the mixture, for example by a compressor driven by the engine power itself.

The fuel mixture contained within the combustion chamber is then ignited by the spark device to produce a substantial pressure increase, and, when the ports 141,143 come into register with the opening 139, the expanded and therefore pressurized gas volume passes into the rotor cavity 125, along the passage 121 in the flap and out through the openings 123. The gas then enters the working chamber 138, to drive the rotor 116 in rotation, in the manner described with reference to FIGS. 2 to 5.

Figure 10:
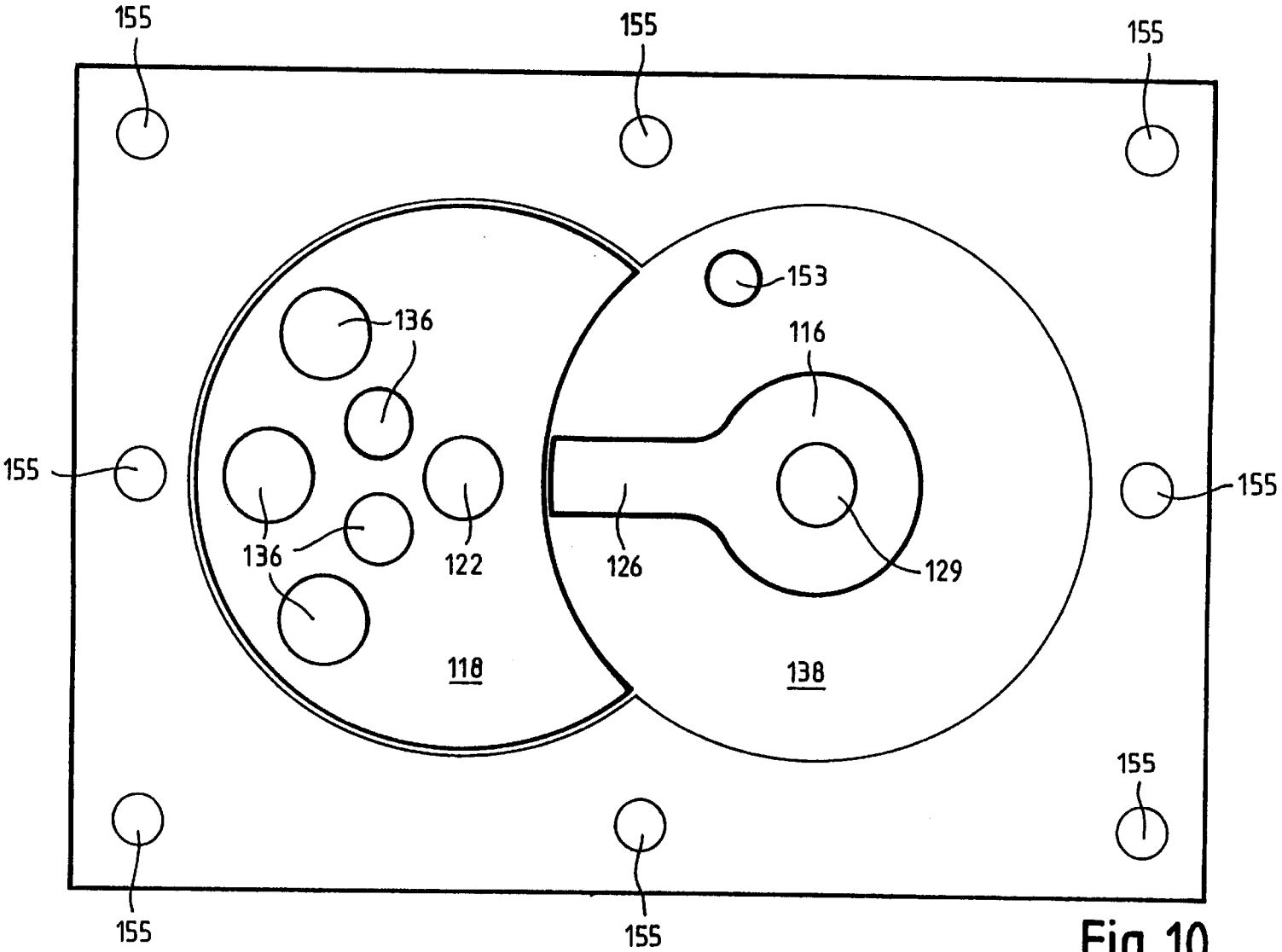
FIG. 10 is a cross-sectional view of the major components of machines in accordance with the invention.

FIG. 10 shows the working chamber 138, which is formed in the plate 110*b*, and with the exhaust port 153 which is formed in the plate 110*c*. The plate 110*c* forms one side wall of the chamber 138. The plates 110*a*,110*b* and 110*c* are held together by bolts passing through bolt holes 155 in all the plates.

In all the embodiments, suitable gaskets, seals and bearings will be provided where necessary, but it is to be noted that there will be no separate seals between the rotors 116,118 and the walls of the working chamber, the necessary sealing function being provided by (a) carefully engineered tolerances between these components to ensure that a narrow gap (but no contact) is maintained between these components, and (b) the arrangement of the outlet passages 123 and the gas pressures which prevent gas flow past the flap 126 in any unintended direction.

The machines described here have significant advantages over known rotary machines. Because there is no contact between the moving parts there will be no friction and thus no abrasion so the service life should be longer than that of machines where a contact seal is required. Because the power stroke drives only the first rotor, with the pressure in the chamber being neutral so far as the second rotor is concerned, all the power is transferred to rotation of the first rotor.

Two (or more) machines of the type described here can be connected together to improve power output and efficiency. It is preferred if the two machines have one rotor spindle in common, but each machine should have its other spindle independent of another machine.

It is a particular feature of the machine described here that it can produce rotation from relatively low pressure compressed gas.

What is claimed is:

1. A rotary machine having two rotors mounted for rotation on parallel axes, each in one of two intersecting cylindrical chambers, a first of the rotors having a hub and a flap extending radially from the hub into close proximity with, but not into contact with, the cylindrical wall of the respective chamber, and the second of the rotors having a hub and a radial recess which accommodates the flap as the rotors rotate, the rotors being linked to one another so that they rotate at the same angular speed but in opposite angular directions, the flap dividing the chamber in which the first rotor rotates into two volumes, one either side of the flap, and the first rotor including an inlet for working fluid, the inlet communicating with a radial passage which extends from a hub of the first rotor into the flap, and ends in a plurality of outlets, all on the same side of the flap, and all in communication with the same radial passage through which incoming working fluid can be directed into a volume on one side of the rotor.

2. A rotary machine as claimed in claim 1, wherein the second rotor has a diameter which, apart from the recess, is substantially equal to that of the chamber in which it rotates.

3. A rotary machine as claimed in claim 1, wherein the two intersecting cylindrical chambers both have the same diameter, and the rotors are linked to one another, externally of the chamber, by intermeshing gears which ensure that both rotors rotate at the same rate.

4. A rotary machine as claimed in claim 1, wherein the outlets are located adjacent the radially outer edge of the flap.

5. A rotary machine as claimed in claim 4, wherein the outlets nearer to the radially outer edge are larger than those further from the edge.

6. A rotary machine as claimed in claim 1, wherein the spindle of the first rotor is hollow and is divided to form an inlet passage at one end and an outlet passage at the other end, with the inlet and outlet passages being separated from one another by the division in the hollow spindle.

7. A rotary machine as claimed in claim 6, wherein part of one end of the spindle is cut away so that, in certain angular orientations, communication is opened between an external inlet passage and the centre of the spindle, and in other angular orientations this communication is closed.

8. A rotary machine as claimed in claim 1, including an outlet passage through which working fluid in front of the flap can be exhausted to atmosphere, the outlet passage being permanently open to maintain a steep pressure gradient across the flap.

9. A rotary machine as claimed in claim 8, wherein the outlet passage is formed by a hole in the side of the chamber in which the first rotor rotates.

10. A rotary machine as claimed in claim 1, wherein the first rotor has a hollow hub which is in communication with the radial passage, and the hub is adapted to be supplied with pressurised working fluid through a port in an end face which periodically during each rotation cycle is in register with a corresponding port in another component which is exposed to the working fluid.

11. A rotary machine as claimed in claim 1, and provided with an external combustion chamber, in which a mixture of fuel and air can be exploded to produce a working fluid under pressure.

12. A rotary machine having two rotors mounted for rotation on parallel axes, each in one of two intersecting cylindrical chambers, a first of the rotors having a hub and a flap extending radially from the hub into close proximity with, but not into contact with, the cylindrical wall of the respective chamber, and the second of the rotors having a hub and a radial recess which accommodates the flap as the rotors rotate, the rotors being linked to one another so that they rotate at the same angular speed but in opposite angular directions, the flap dividing the chamber in which the first rotor rotates into two volumes, one either side of the flap, and the first rotor including an inlet for working fluid, the inlet communicating with a radial passage through the rotor to direct incoming working fluid into a volume on one side of the rotor;

wherein the rotary machine is provided with an external combustion chamber, in which a mixture of fuel and air can be exploded to produce a working fluid under pressure; and wherein the combustion chamber rotates with the first rotor.

* * * * *